US008294758B2

(12) United States Patent
Lynde

(10) Patent No.: US 8,294,758 B2
(45) Date of Patent: Oct. 23, 2012

(54) DOWNHOLE FISH-IMAGING SYSTEM AND METHOD

(75) Inventor: Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 1052 days.

(21) Appl. No.: 12/026,285

(22) Filed: Feb. 5, 2008

(65) Prior Publication Data

US 2009/0195647 A1 Aug. 6, 2009

(51) Int. Cl.
*H04N 9/47* (2006.01)
*H04N 7/18* (2006.01)

(52) U.S. Cl. ..... 348/81; 33/552

(58) Field of Classification Search ..... 348/81; 33/552

See application file for complete search history.

(56) References Cited

U.S. PATENT DOCUMENTS

| | | | | |
|---|---|---|---|---|
| 4,488,747 | A | 12/1984 | Austin | |
| 6,298,587 | B1 * | 10/2001 | Vollom | 40/427 |
| 6,700,563 | B1 * | 3/2004 | Koizumi | 345/156 |
| 6,860,784 | B2 | 3/2005 | Chernov et al. | |
| 6,907,672 | B2 * | 6/2005 | Said | 33/552 |
| 7,047,657 | B2 * | 5/2006 | Goeggelmann et al. | 33/552 |
| 7,268,697 | B2 | 9/2007 | Hall et al. | |
| 2002/0024594 | A1 * | 2/2002 | Yamamuro | 348/81 |
| 2003/0203348 | A1 * | 10/2003 | Chernov et al. | 434/365 |
| 2004/0073399 | A1 * | 4/2004 | Benson et al. | 702/168 |
| 2007/0056178 | A1 * | 3/2007 | Kleyman et al. | 33/561.1 |

OTHER PUBLICATIONS

Downhole Camera (DHC) Services, Advanced Downhole Imaging Services that Allow You to Literally "See" Borehole Conditions. Halliburton. Nov. 2007. 6 pages.

Prensky, Stephen E., "Advances in Borehole Imaging Technology and Applications," Geological Society, London, Special Publications; 1999; v. 159; DOI: 10.1144/GSL.SP.1999.159.01.01 12 pages.

Tague, J.R., et al., "Downhole Video: A Cost/Benefit Analysis," SPE 62522, Society of Petroleum Engineers, Long Beach, California, Jun. 19-23, 2000., p. 1.

Xie, C.G., et al., "Imaging Technologies in Oilfield Applications," Journal of Zhejiang University Science, Oct. 2005. 7 pages.

Omega Downhole Memory Camera, Omega Completion Technology, Ltd., 1 page, Copyright 2001. Retrieved online on Sep. 17, 2008 from: http://pi-intervention.testwebb.no/files/downhole_memory_camera.pdf.

* cited by examiner

*Primary Examiner* — Liangche A Wang
(74) *Attorney, Agent, or Firm* — Cantor Colburn LLP

(57) ABSTRACT

Disclosed herein is a downhole fish-imaging system. The fish-imaging system includes, a fish-imaging device positionable downhole near the fish, and a processor. The fish-imaging device has at least one shape changeable portion with a plurality of sensors therein for monitoring the shape of the at least one shape changeable portion, a shape of the at least one shape changeable portion is influenced by a shape of the fish. The processor is in operable communication with the fish-imaging device and is coupled to a wired pipe for transmitting data therealong from the sensors.

18 Claims, 2 Drawing Sheets

DOWNHOLE FISH-IMAGING SYSTEM AND METHOD

BACKGROUND OF THE INVENTION

In the hydrocarbon recovery industry, fishing is a well known part of the art to retrieve stuck or broken tools from the downhole environment. The fish can obstruct further downhole operations such as drilling and production and should therefore be removed from the well bore. To facilitate removal (fishing), it is helpful to have knowledge of the size and shape of the fish. Such knowledge allows an operator to employ a fishing tool with a high likelihood of successfully grasping the fish on the first attempt thereby avoiding the cost and time associated with multiple fishing attempts, which commonly include multiple runs into and out of the borehole. New tools and methods for acquiring knowledge of the size and shape of a fish are, therefore, desirable in the art.

BRIEF DESCRIPTION OF THE INVENTION

Disclosed herein is a downhole fish-imaging system. The fish-imaging system includes, a fish-imaging device positionable downhole near the fish, and a processor. The fish-imaging device has at least one shape changeable portion with a plurality of sensors therein for monitoring the shape of the at least one shape changeable portion, a shape of the at least one shape changeable portion is influenced by a shape of the fish. The processor is in operable communication with the fish-imaging device and is coupled to a wired pipe for transmitting data therealong from the sensors.

Further disclosed herein is a downhole fish-imaging device. The fish-imaging device includes a housing positionable downhole near the fish, and a plurality of pins engaged with the housing such that each of the plurality of pins is longitudinally movable relative to the housing from a first position to a second position and the second position is defined by contact with the fish or completion of an imaging session.

Further disclosed herein is a method of imaging a downhole fish. The method includes, positioning a fish-imaging device downhole at the fish, displacing a plurality of pins from a first position to a second position the second position relating to a characteristic of the fish, and determining an image of the fish with the second position of the plurality of pins.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
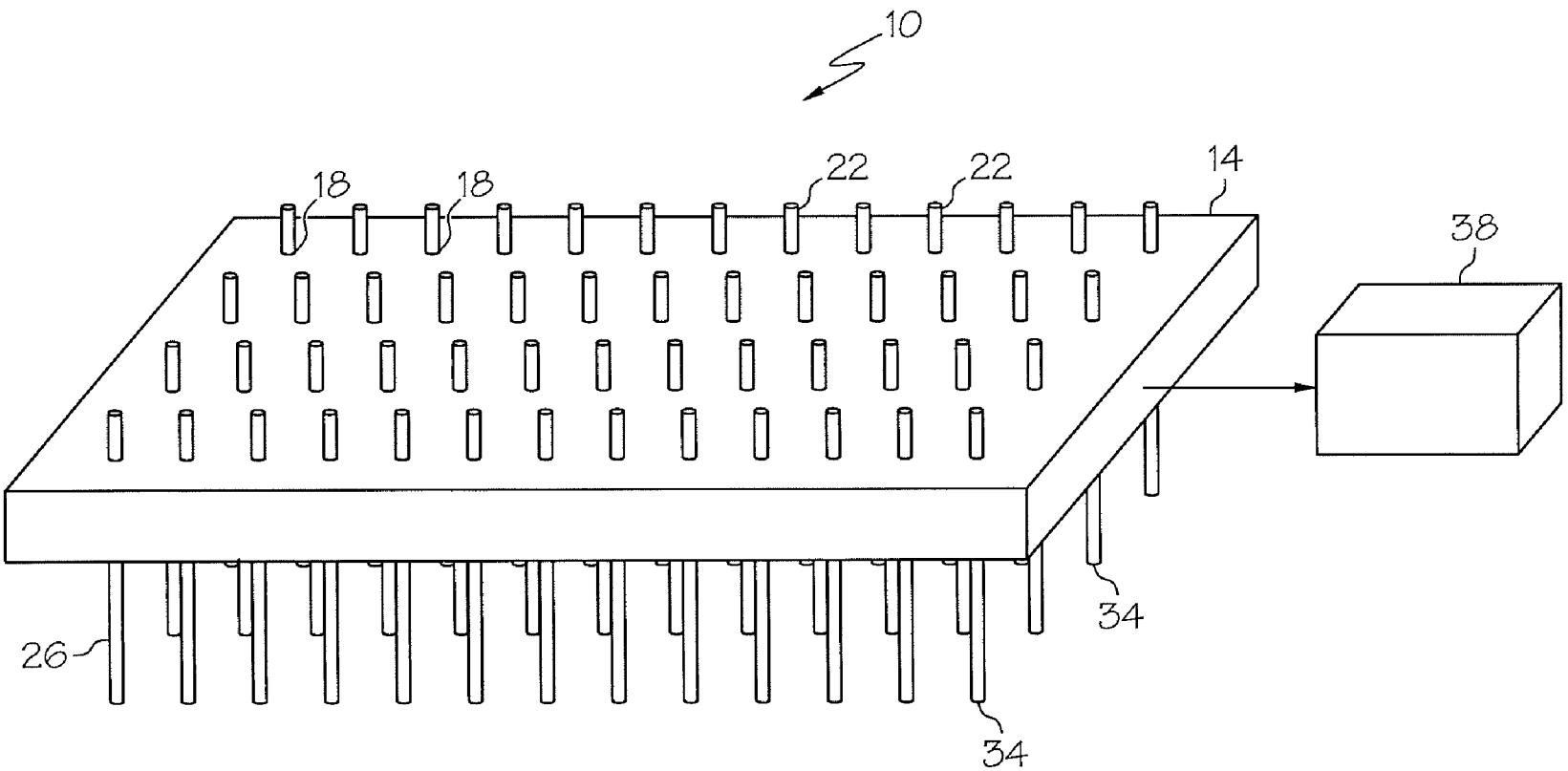
FIG. 1 depicts a perspective view of an embodiment of the fish-imaging device disclosed herein.
Figure 2:
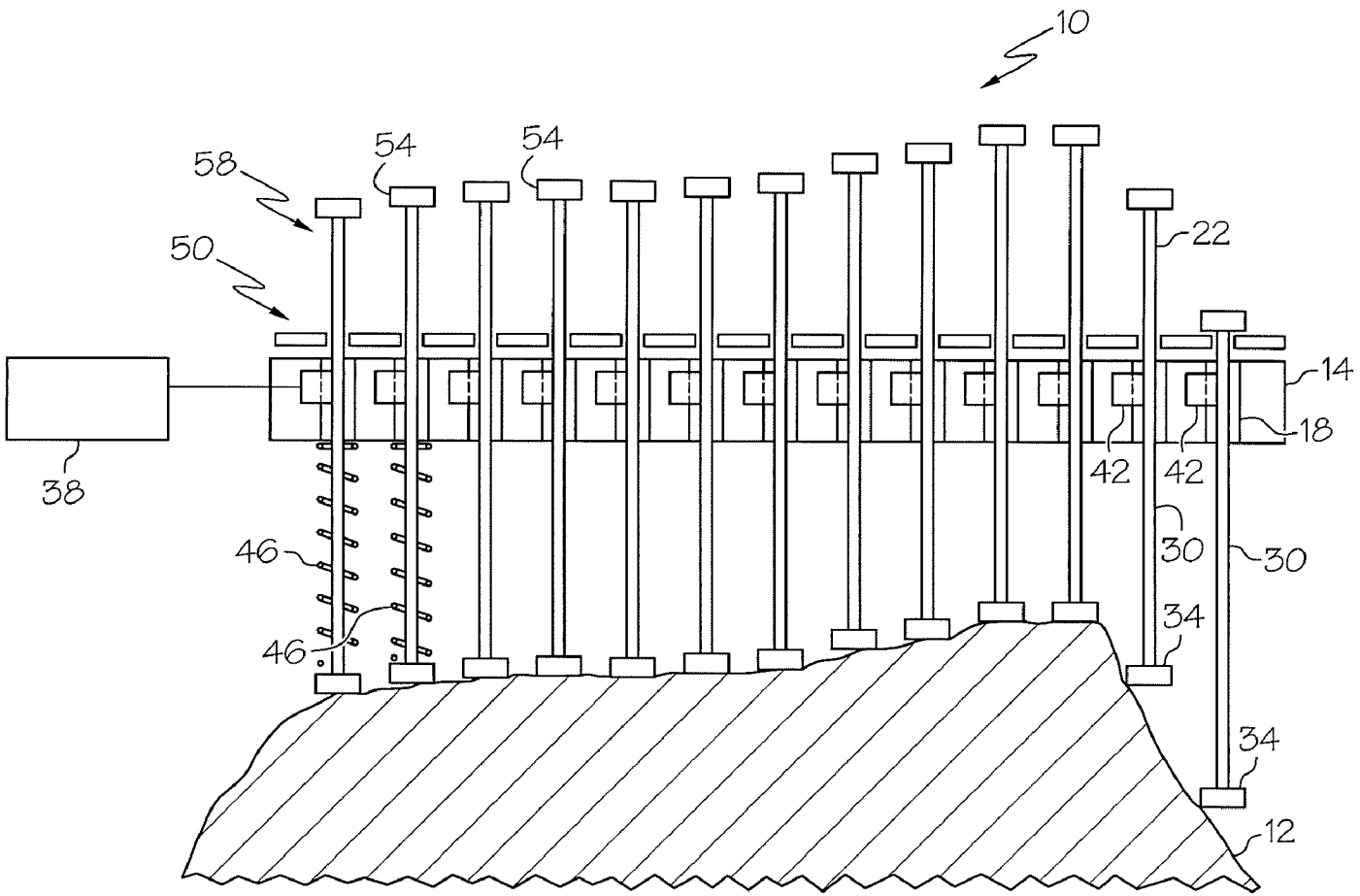
FIG. 2 depicts a cross-sectional view of another embodiment of the fish-imaging device disclosed herein.

Referring to FIGS. 1 and 2, an embodiment of the fish-imaging device 10 disclosed herein is illustrated. The fish-imaging device 10 is positionable downhole near a fish 12 (FIG. 2) to be imaged. The fish-imaging device 10, of this embodiment, is a shape changeable device that includes, a housing 14 having a plurality of apertures 18 with each of the plurality of apertures 18 having a pin 22 positioned therein. Each of the pins 22 is longitudinally movable relative to the housing 14 from a first position 26 to a second position 30, as well as to any position therebetween. The first position 26 being a position of the pins 22 in which the fish-imaging device 10 is deployed, for example, while the second position 30 is defined by a first end 34 of each pin 22 contacting the fish 12 being imaged. A three dimensional image of the fish 12, including a size and shape of the fish 12, can thereby be represented by the plurality of first ends 34 of the pins 22 while in the second position 30.

Retrieving the size and shape of the fish 12 to surface can be achieved in different ways. For example, the pins 22 can be locked relative to the housing 14 in the second position 30 and the fish-imaging device 10 retrieved to surface for analysis of the locations of the first ends 34. Such locking can be achieved through various means, such as, by friction between the housing 14 and the pins 22 or by locking the pins 22 to the housing 14 with one or more locking members (not shown) positioned at the housing 14 that are moved relative to the housing 14 to load each pin 22 between the one or more locking members and the housing 14, for example.

In an alternate embodiment, the size and shape of the fish 12 can be communicated to surface while the fish-imaging device 10 remains downhole. In this embodiment, a processor 38 monitors a plurality of sensors 42 that measure a position of each of the pins 22 relative to the housing 14. The processor 38 transmits at least the second position 30 of each pin 22 to surface via a communication system (not shown). The communication system can use wired pipe, wireline, acoustic transmission, mud pulse telemetry, electromagnetic telemetry or other known communication methods. The wired-pipe method provides bandwidth capable of quickly transmitting a large amount of data, including at least the second positions 30 of each of the pins 22, to surface. The amount of data transmitted to surface can be minimized by digitally processing and compressing an image generated by the second positions 30 of the pins 22 downhole before sending the compressed data to surface. Additionally, memory can be used downhole to store either compressed or uncompressed images for sending to surface at a later time, with initiation on when to capture as well as when to send to surface being initiated at the surface.

The sensors 42 can monitor the positions 26, 30 of the pins 22 in a variety of ways; one example is by measuring a resistance that varies along the longitudinal length of each pin 22. Such measuring can be through an electrical contact attached to each of the sensors 42 and slides along each of the pins 22 thereby forming a potentiometer as the pins 22 move between the first position 26 and the second position 30. Another example is to monitor the position of each pin 22 with a linear variable differential transformer (LVDT).

Movement of the pins 22 from the first position 26 to the second position 30 can also be accomplished in more than one way. One way is to move the housing 14 toward the fish 12 so that engagement of the first ends 34 with the fish 12 causes the pins 22 to move relative to the housing 14 as the housing 14 continues to move toward the fish 12. Another way is to position the housing 14 near the fish 12 and then to hold the housing 14 stationary relative to the fish 12 while the pins 22 move toward the fish 12. Each pin 22, upon contact with the fish 12, will cease to move as the pin 22 has reached the second position 30. In both of these embodiments the pins 22 move from the first position 26 to the second position 30 with the second position 30 being defined by contact of the first end 34 with the fish 12. Movement of the pins 22 with the stationary housing 14 can be achieved using springs 46 that are prevented from moving the pins 22 until the pins 22 are released by one or more locking members as described earlier, for example. Initiation to release the one or more locking members can be via communication link from surface, for example. Such one or more locking members could also be reengaged with the pins 22 once the pins 22 have contacted the fish 12 and are in the second position 30.

Additionally, the pins 22 could be repositioned from the second position 30 back to the first position 26 to allow the fish-imaging device 10 to acquire multiple images of the fish 12 without being retrieved to surface. Such repositioning could be accomplished with a resetting plate 50, which is moved through energizing a solenoid (not shown) that moves the resetting plate 50, which engages with heads 54 on a second end 58 of the pins 22 to reposition the pins 22 back to the first position 26. Initiation of the repositioning of the pins 22 could be from surface via any of the communication methods described above.

Although the embodiment disclosed herein shows a housing 14 with a planar shape such that the plurality of pins 22 move substantially parallel to one another, alternate embodiments could have alternate configurations. For example, the shape-changing portion could be cylindrical in shape with a plurality of pins that are movable in substantially radial directions. Such an embodiment could sense an inner or an outer perimetrical surface of a fish, for example. Additionally, the shape-changing portion is not limited to pins movable relative to a housing. For example, a shape-changing member could have an inflatable bladder that expands in multiple directions simultaneously to cause engagement with the fish after which sensors located within the bladder can sense a size and shape of the fish.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A downhole fish-imaging system, comprising:

a fish-imaging device positionable downhole near a fish positioned downhole, having at least one shape changeable portion with a plurality of sensors therein for monitoring the shape of the at least one shape changeable portion, a shape of the at least one shape changeable portion being changeable in response to contact with the fish to a shape influenced by a shape of the fish; and a processor in operable communication with the fish-imaging device coupled to a wired pipe for transmitting data therealong from the sensors.

2. The downhole fish-imaging system of claim 1, wherein the at least one shape changing portion further comprises:

a housing; and a plurality of pins engaged with the housing such that each of the plurality of pins is longitudinally movable relative to the housing from a first position to a second position the first position being an initial position and the second position being defined by contact with the fish or completion of an imaging session.

3. The downhole fish-imaging system of claim 2, further comprising a pin position sensor able to determine the position of each of the plurality of pins relative to the housing.

4. The downhole fish-imaging system of claim 2, wherein the plurality of pins are substantially parallel with one another.

5. The downhole fish-imaging system of claim 2, wherein the plurality of pins are substantially oriented along radial vectors.

6. A downhole fish-imaging device, comprising:

a housing positionable downhole near a fish positioned downhole; and a plurality of pins engaged with the housing such that each of the plurality of pins is longitudinally movable relative to the housing from a first position to a second position the second position being defined by contact with the fish or completion of an imaging session, the device being configured to transmit information relating to the second position through a wired pipe.

7. The downhole fish-imaging device of claim 6, wherein the housing is configured to maintain the plurality of pins in the second position while the imaging device is retrieved to surface for inspection.

8. The downhole fish-imaging device of claim 6, wherein the plurality of pins are maintained in the second position with friction.

9. The downhole fish-imaging device of claim 6, further comprising at least one locking member within the housing the at least one locking member being lockably engagable with the plurality of pins in at least one of the first position and the second position.

10. The downhole fish-imaging device of claim 6, wherein the fish-imaging device is configured to move the housing and the plurality of pins toward the fish to thereby cause movement of the plurality of pins from the first position to the second position in response to contact of at least one of the plurality of pins with the fish.

11. The downhole fish-imaging device of claim 6, wherein the fish-imaging device is configured to move the plurality of pins relative to the housing from the first position to the second position.

12. The downhole fish-imaging device of claim 6, further comprising a pin repositioning device to reposition the plurality of pins from the second position to the first position.

13. A method of imaging a downhole fish, comprising:

positioning a fish-imaging device downhole at the fish;

displacing a plurality of pins from a first position to a second position through contact of the plurality of pins with the fish the second position thereby relating to a characteristic of the fish;

determining an image of the fish with the second position of the plurality of pins;

sensing the second position of the plurality of pins; and transmitting the second position of the plurality of pins to surface via wired pipe.

14. The method of imaging a downhole fish of claim 13, wherein the characteristic is a contact point on the fish.

15. The method of imaging a downhole fish of claim 13, wherein the displacing a plurality of pins includes contacting the fish with at least one of the plurality of pins while moving the fish-imaging device.

16. The method of imaging a downhole fish of claim 13, wherein the displacing a plurality of pins includes moving the plurality of pins relative to a housing of the fish-imaging device until at least one of the plurality of pins contacts the fish.

17. The method of imaging a downhole fish of claim 13, further comprising locking the plurality of pins in the second position.

18. The method of imaging a downhole fish of claim 13, further comprising repositioning the plurality of pins to the first position.

* * * * *